US007581533B1

(12) United States Patent
Moran

(10) Patent No.: US 7,581,533 B1
(45) Date of Patent: Sep. 1, 2009

(54) THREE MODE COOLER FOR EXHAUST GAS RECIRCULATION

(75) Inventor: Robert J. Moran, Ann Arbor, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/248,076

(22) Filed: Oct. 9, 2008

(51) Int. Cl.
*F02B 47/08* (2006.01)
*F02B 47/10* (2006.01)

(52) U.S. Cl. ..... 123/568.12

(58) Field of Classification Search ..... 123/568.12, 123/568.11; 165/103, 153, 158; 60/321, 60/320, 605.2
See application file for complete search history.

(56) References Cited

U.S. PATENT DOCUMENTS

| | | | | |
|---|---|---|---|---|
| 7,077,114 | B2 * | 7/2006 | Husges | 123/568.12 |
| 2007/0289581 | A1 * | 12/2007 | Nakamura | 123/568.12 |
| 2008/0314569 | A1 * | 12/2008 | Yamazaki et al. | 165/153 |
| 2009/0044525 | A1 * | 2/2009 | Husges et al. | 60/321 |

* cited by examiner

*Primary Examiner*—Mahmoud Gimie
(74) *Attorney, Agent, or Firm*—Quinn Law Group, PLLC

(57) ABSTRACT

An exhaust gas recirculation system for an engine provides three modes of operation. In a bypass mode, exhaust gas bypasses a heat exchanger. In a single pass mode of operation, exhaust gas flows through the heat exchanger passageways. In a dual pass mode of operation, exhaust gas flows through the heat exchanger passageways in a manner that provides a longer effective flow length through the heat exchanger compared to the single pass mode, thereby to increase cooling efficacy.

13 Claims, 2 Drawing Sheets

THREE MODE COOLER FOR EXHAUST GAS RECIRCULATION

TECHNICAL FIELD

This invention relates to cooling systems for exhaust gas recirculation in engines.

BACKGROUND OF THE INVENTION

Vehicles typically include an exhaust gas recirculation (EGR) system to selectively direct internal combustion engine exhaust gas to an air inlet of the engine. EGR can lower the level of certain undesirable engine emission components such as nitrogen oxide (NOx) and can improve fuel economy. Up to a limit, NOx emissions decrease with increasing EGR levels. Beyond the limit, EGR can increase formation of other undesirable engine emission components and can reduce vehicle drivability.

EGR typically involves recirculation of exhaust gas through an EGR passage between an engine exhaust conduit and an engine fresh air intake passage. A valve within the EGR passage (the EGR valve) is controlled to vary a restriction within the EGR passage to regulate the flow of exhaust gas therethrough. In compression ignition engines, recirculated exhaust gas may be cooled to enable induction of a greater mass of exhaust gas into the engine cylinders.

SUMMARY OF THE INVENTION

An exhaust gas recirculation system is provided for an engine having an exhaust manifold and an intake manifold. The system includes a valve assembly including a valve housing and at least one valve member. The valve housing defines a first port and a second port, and is operatively connectable to the engine such that the first port receives exhaust gas from the exhaust manifold and the second port is in fluid communication with the intake manifold. A heat exchanger defines a first passageway and a second passageway. The at least one valve member is selectively movable with respect to the valve housing to provide first, second, and third modes of operation.

In the first mode of operation, exhaust gas from the inlet port flows to the outlet port without flowing through either of the first and second passageways of the heat exchanger. In the second mode of operation, exhaust gas from the inlet port flows through the first and second passageways in series to the outlet port. In the third mode of operation, exhaust gas from the inlet port flows through the first and second passageways in parallel to the outlet port.

The first mode of operation provides a low resistance flow path for exhaust gas when EGR cooling is not desired. The second mode of operation provides a high degree of EGR cooling due to the longer effective flow path of exhaust gas through the heat exchanger compared to the third mode of operation. The third mode of operation provides EGR cooling with a lower flow restriction compared to the second mode.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
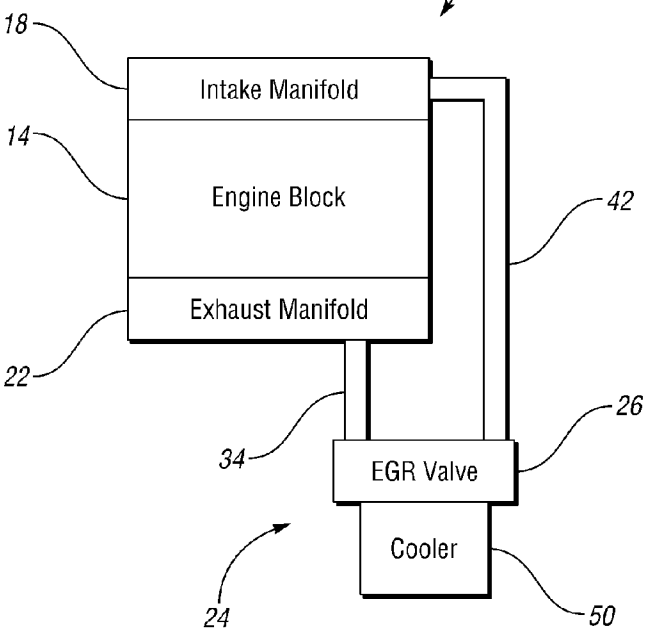
FIG. 1 is a schematic depiction of an engine including an exhaust gas recirculation system.

Referring to FIG. 1, an engine 10 includes an engine block 14, which defines a plurality of cylinders (not shown). Each of the cylinders contains a respective piston (not shown), as understood by those skilled in the art. An intake manifold 18 is mounted with respect to the engine block 14 and defines a plurality of passageways that provide fluid communication between the cylinders and the atmosphere. Thus, the intake manifold 18 distributes air from the atmosphere to the cylinders. Intake valves (not shown) are operative to regulate the flow of air between the cylinders and the intake manifold 18, as understood by those skilled in the art.

An exhaust manifold 22 is mounted with respect to the engine block 14 and is in selective fluid communication with the cylinders to receive exhaust gases therefrom. As understood by those skilled in the art, exhaust valves (not shown) are operative to regulate the flow of exhaust from the cylinders to the exhaust manifold 22. In an exemplary embodiment, engine 10 is of the compression ignition type.

Figure 2:
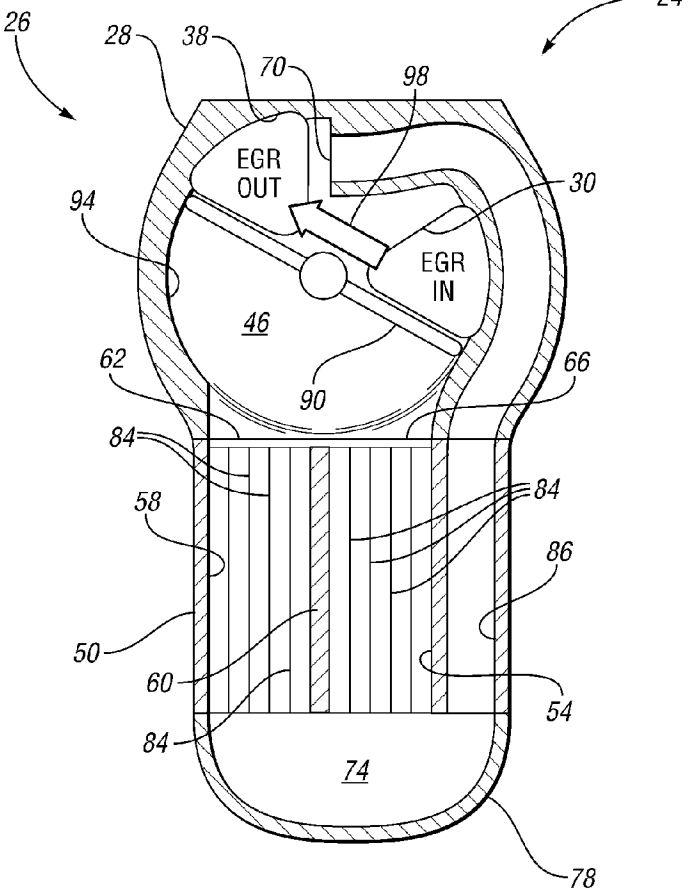
FIG. 2 is a schematic, sectional side view of the exhaust gas recirculation system of FIG. 1 with a valve member in a first position.

An exhaust gas recirculation (EGR) system 24 is configured to provide selective fluid communication between the exhaust manifold 22 and the intake manifold 18. The EGR system 24 includes a valve assembly 26. Referring to FIGS. 1 and 2, the valve assembly 26 includes a housing 28 that defines an inlet port 30 in fluid communication with the exhaust manifold 22 via conduit 34. Accordingly, during operation of the engine 10, the inlet port 30 receives exhaust gas from the exhaust manifold 22.

The housing 28 also defines an outlet port 38 in fluid communication with the intake manifold 18 via conduit 42. The housing 28 further defines a chamber 46 in fluid communication with the inlet port 30 and the outlet port 38. A heat exchanger 50 is operatively connected to the valve assembly 26.

Referring specifically to FIG. 2, the heat exchanger 50 defines a first passageway 54 and a second passageway 58, which are divided by a wall 60. The housing 28 further defines ports 62, 66, 70. Passageway 54 provides fluid communication between port 66 and a chamber 74. Passageway 58 provides fluid communication between port 62 and chamber 74. Chamber 74 is defined by a rear header 78 mounted with respect to the heat exchanger 50. The heat exchanger 50 is configured to transfer heat from exhaust gas in the passageways 54, 58 to a cooler fluid, such as water or air. Thus, the heat exchanger 50 cools exhaust gas as the exhaust gas flows through the passageways 54, 58. Cooling fins 84 in passageways 54, 58 provide increased surface area for heat transfer between exhaust gas and the cooling fluid. Housing 28 and the heat exchanger 50 cooperate to define a passageway 86 that provides fluid communication between chamber 74 and port 70, and thus passageway 86 provides selective fluid communication between chamber 74 and chamber 46.

Chamber 46 provides selective fluid communication between all of the ports 30, 38, 62, 66, 70. In the embodiment depicted, chamber 46 is generally circular in cross section. A butterfly valve member 90 is rotatably mounted with respect to the valve body 26 inside the chamber 46, and is in sealing engagement with the wall 94 of the chamber 46. The valve member 90 is movable between three positions to control fluid communication between the ports 30, 38, 62, 66, 70 such that the EGR system 24 is characterized by three modes of operation.

In a bypass mode of operation, shown in FIG. 2, the valve member 90 is in a first position in which the valve member 90 prevents fluid communication from the inlet port 30 to ports 62, 66, i.e., EGR is prevented from flowing across the chamber 46 from the inlet port 30 to either of ports 62, 66. In the first position, valve member 90 does not obstruct fluid flow from the inlet port 30 to the outlet port 38 via the chamber 46. Accordingly, in the bypass mode of operation, exhaust gas 98 flows from the inlet port 30, through the chamber 46, to the outlet port 38. Thus, in the bypass mode of operation, exhaust gas 98 does not flow through the heat exchanger 50 as it is transmitted from the exhaust manifold to the intake manifold. In the first position, the valve member 90 does not prevent fluid flow from the inlet port 30 to port 70; however, exhaust gas does not flow through the return passageway 86 because the valve member 90 deadheads ports 62, 66.

Figure 3:
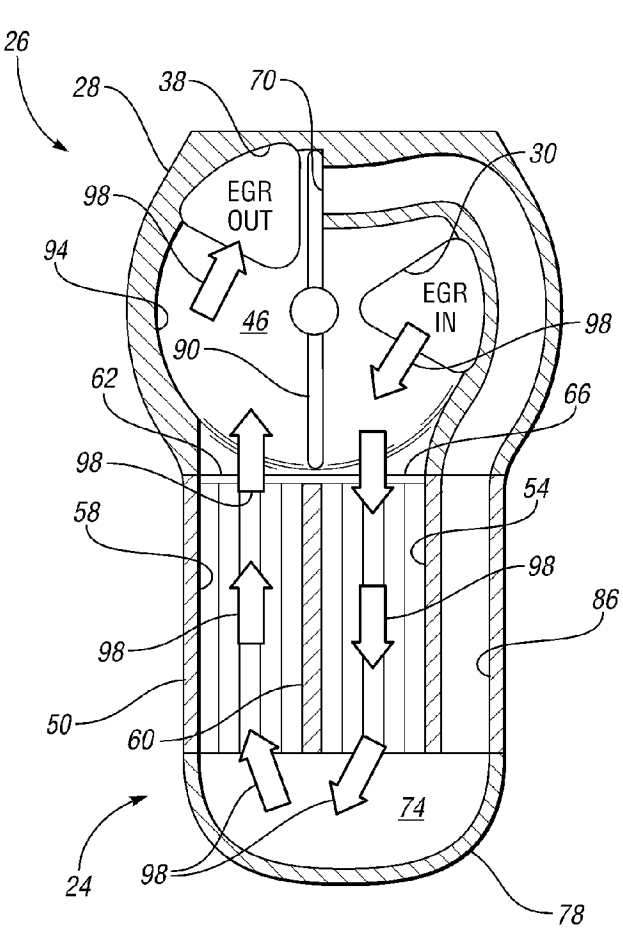
FIG. 3 is a schematic, sectional side view of the exhaust gas recirculation system of FIG. 1 with a valve member in a second position.

In a dual pass mode of operation, shown in FIG. 3, valve member 90 is in a second position in which the valve member 90 obstructs fluid communication from port 70 to the chamber 46. Valve member 90 directs flow in the chamber 46 from the inlet port 30 to port 66, and from port 62 to the outlet port 38. Valve member 90 obstructs flow across the chamber 46 from the inlet port 30 to port 62 and port 38. Accordingly, when the valve member 90 is in the second position, exhaust gas 98 from the inlet port 30 flows through port 66, then through the first passageway 54, then through chamber 74, then through the second passageway 58, then through port 62, to the outlet port 38. Thus, during the second mode of operation, exhaust gas 98 that flows through the inlet port 30 flows through the first passageway 54 and the second passageway 58 consecutively. That is, exhaust gas 98 flows through passageway 54 and then through passageway 58 in series.

Figure 4:
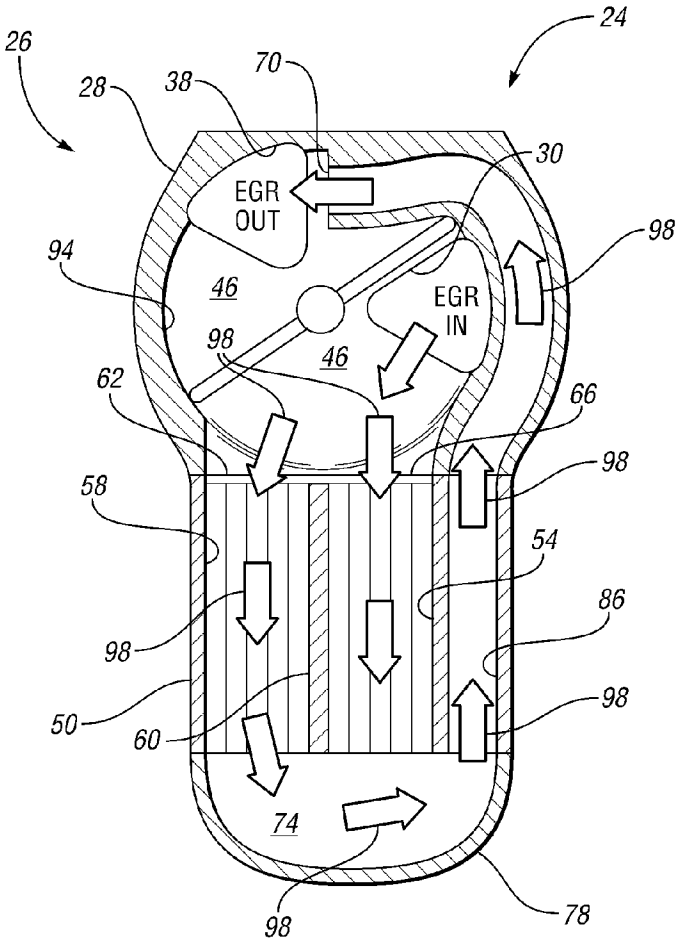
FIG. 4 is a schematic, sectional side view of the exhaust gas recirculation system of FIG. 1 with a valve member in a third position.

In a single pass mode of operation, shown in FIG. 4, valve member 90 is in a third position in which the valve member 90 prevents exhaust gas flow from the inlet port 30 to the outlet port 38 across the chamber 46. Rather, valve member 90 directs exhaust gas 98 from the inlet port 30 across the chamber 46 to both port 62 and port 66. Thus, some of the exhaust gas 98 that enters the chamber 46 from port 30 travels through passageway 54, and some of the exhaust gas 98 that enters the chamber 46 from port 30 travels through passageway 58. That is, exhaust gas 98 flows through passageway 58 and through passageway 54 in parallel. The direction of flow of exhaust gas 98 in passageway 58 in the third mode of operation is opposite the direction of flow in passageway 58 in the second mode of operation.

Exhaust gas 98 from the passageways 54, 58 enters chamber 74, then flows through passageway 86 to port 70. Port 70 is in fluid communication with the outlet port 38 via chamber 46, and thus the exhaust gas 98 from the passageway 86 flows through the outlet port 38 and to the intake manifold. The valve member 90 prevents fluid communication between port 70 and ports 30, 62, 66.

The bypass mode of operation of the EGR system 24, as shown in FIG. 2, may be used, for example, during a cold start of the engine 14, when exhaust gas cooling is not necessary and when exhaust gas pressure is low. The dual pass mode of operation may be used, for example, when a high differential pressure is present between the exhaust manifold and the intake manifold. The dual pass mode of operation has increased flow resistance than the single pass mode, but is characterized by a high degree of cooling because the effective flow length of the exhaust gas in the heat exchanger 50 is larger in the dual pass mode than in the single pass mode. Assuming, for example, that the first and second passageways 54, 58 are of equal length, then the exhaust gas flows twice the distance through the heat exchanger 50 in the dual pass mode than in the single pass mode.

The single pass mode may be used, for example, when EGR cooling is desired but there is a relatively low pressure differential between the exhaust manifold and the intake manifold. The effective flow length of the exhaust gas through the heat exchanger 50 in the single pass mode is approximately half the effective flow length of the exhaust gas in the dual pass mode (assuming passageways 54, 58 have identical lengths). However, the exhaust gas is distributed between the two passageways 54, 58, and therefore is distributed across a greater cross sectional area than in the dual pass mode. The shorter effective flow length and the larger flow area provide reduced flow resistance than in the dual pass mode. The slower velocity of the exhaust gas in the single pass mode compared to the dual pass mode permits effective EGR cooling in the heat exchanger 50.

It should be noted that other valve configurations may be employed within the scope of the claimed invention to achieve the three modes of operation described herein. For example, in an alternative embodiment, and within the scope of the claimed invention, the valve housing may be such that the ports are aligned linearly, and a slide valve (not shown) is selectively movable to control the flow between the ports to achieve the three modes of operation. In another alternative embodiment, and within the scope of the claimed invention, more than one valve member may be employed to control the flow of exhaust gas between the ports.

Those skilled in the art will recognize that another valve (not shown) may be employed within the EGR system 24 to regulate the amount of exhaust gas diverted from the exhaust manifold to the intake manifold within the scope of the claimed invention.

While the best modes for carrying out the invention have been described in detail, those familiar with the art to which this invention relates will recognize various alternative designs and embodiments for practicing the invention within the scope of the appended claims.

The invention claimed is:

1. An exhaust gas recirculation system for an engine having an exhaust manifold and an intake manifold, comprising:

a valve assembly including a valve housing and at least one valve member, the valve housing defining a first port and a second port and being operatively connectable to the engine such that the first port receives exhaust gas from the exhaust manifold and the second port is in fluid communication with the intake manifold; and a heat exchanger defining a first passageway and a second passageway;

wherein the at least one valve member is selectively movable with respect to the valve housing to provide a first mode of operation in which exhaust gas from the inlet port flows to the outlet port without flowing through either of the first and second passageways of the heat exchanger, a second mode of operation in which exhaust gas from the inlet port flows through the first and second passageways in series to the outlet port, and a third mode of operation in which exhaust gas from the inlet port flows through the first and second passageways in parallel to the outlet port.

2. The exhaust gas recirculation system of claim 1, further comprising structure defining a third passageway providing selective fluid communication between the first and second passageways and the outlet port; and wherein the at least one valve member prevents fluid flow through the third passageway during the first and second modes of operation, and permits fluid flow through the third passageway during the third mode of operation.

3. The exhaust gas recirculation system of claim 1, wherein the at least one valve member is a butterfly valve that is selectively rotatable with respect to the valve housing.

4. An exhaust gas recirculation system for an engine having an exhaust manifold and an intake manifold, comprising:

a valve assembly including a valve housing and at least one valve member, the valve housing defining a chamber having first, second, third, fourth, and fifth ports and being operatively connectable to the engine such that the chamber receives exhaust gas from the exhaust manifold through the first port and such that the chamber is in fluid communication with the intake manifold via the second port;

a heat exchanger defining a first passageway in fluid communication with the third port and a second passageway in fluid communication with the fourth port;

structure defining a third passageway providing fluid communication between the first and second passageways and the fifth port;

wherein the at least one valve member is selectively movable with respect to the valve housing to provide a first mode of operation in which exhaust gas from the first port flows to the second port without flowing through either of the first and second passageways of the heat exchanger, a second mode of operation in which exhaust gas from the first port flows through the first and second passageways consecutively, and a third mode of operation in which exhaust gas from the inlet port flows through the first, second, and third passageways.

5. The exhaust gas recirculation system of claim 4, wherein the exhaust gas flows through the second passageway in a first direction in the second mode; and wherein the exhaust gas flows through the second passageway in a second direction opposite the first direction in the third mode.

6. The exhaust gas recirculation system of claim 4, wherein the exhaust gas from the first port exits the chamber through the third and fourth ports and re-enters the chamber via the fifth port in the third mode.

7. The exhaust gas recirculation system of claim 6, wherein the exhaust gas from the first port exits the chamber through the third port and re-enters the chamber via the fourth port in the second mode.

8. The exhaust gas recirculation system of claim 4, wherein the at least one valve member is a butterfly valve that is selectively rotatable within the chamber between first, second, and third positions corresponding to the first, second, and third modes of operation, respectively.

9. An engine comprising:

an intake manifold;

an exhaust manifold;

a valve assembly including a valve housing and at least one valve member, the valve housing defining a chamber having first, second, third, fourth, and fifth ports and being operatively connected to the engine such that the chamber receives exhaust gas from the exhaust manifold through the first port and such that the chamber is in fluid communication with the intake manifold via the second port;

a heat exchanger defining a first passageway in fluid communication with the third port and a second passageway in fluid communication with the fourth port;

structure defining a third passageway providing fluid communication between the first and second passageways and the fifth port;

wherein the at least one valve member is selectively movable with respect to the valve housing to provide a first mode of operation in which exhaust gas from the first port flows to the second port without flowing through either of the first and second passageways of the heat exchanger, a second mode of operation in which exhaust gas from the first port flows through the first and second passageways consecutively, and a third mode of operation in which exhaust gas from the inlet port flows through the first, second, and third passageways.

10. The engine of claim 9, wherein the exhaust gas flows through the second passageway in a first direction in the second mode; and wherein the exhaust gas flows through the second passageway in a second direction opposite the first direction in the third mode.

11. The engine of claim 9, wherein the exhaust gas from the first port exits the chamber through the third and fourth ports and re-enters the chamber via the fifth port in the third mode.

12. The engine of claim 11, wherein the exhaust gas from the first port exits the chamber through the third port and re-enters the chamber via the fourth port in the second mode.

13. The exhaust gas recirculation system of claim 9, wherein the at least one valve member is a butterfly valve that is selectively rotatable within the chamber between first, second, and third positions corresponding to the first, second, and third modes of operation, respectively.

* * * * *